US007666053B2

(12) United States Patent
O'Keefe

(10) Patent No.: US 7,666,053 B2
(45) Date of Patent: Feb. 23, 2010

(54) PACKAGE FOR MAGNETIC TOY VEHICLES

(75) Inventor: William O'Keefe, Redondo Beach, CA (US)

(73) Assignee: Mattel, Inc., El Segundo, CA (US)

( * ) Notice: Subject to any disclaimer, the term of this patent is extended or adjusted under 35 U.S.C. 154(b) by 430 days.

(21) Appl. No.: 11/594,357

(22) Filed: Nov. 6, 2006

(65) Prior Publication Data

US 2007/0197122 A1 Aug. 23, 2007

Related U.S. Application Data

(60) Provisional application No. 60/734,434, filed on Nov. 7, 2005.

(51) Int. Cl.
*A63H 33/04* (2006.01)

(52) U.S. Cl. ..... 446/75; 206/758

(58) Field of Classification Search ..... 446/75; 206/758

See application file for complete search history.

(56) References Cited

U.S. PATENT DOCUMENTS

| | | | |
|---|---|---|---|
| 577,730 | A | 2/1897 | Eberhardt |
| 1,533,540 | A | 4/1925 | Craigen |
| 2,528,938 | A | 11/1950 | Wolf |
| 2,590,002 | A | 3/1952 | Frazier |
| 2,904,336 | A | 9/1959 | Washburn |
| 2,975,551 | A | 3/1961 | Oberinger |
| 3,045,393 | A | 7/1962 | Knott |
| 3,091,459 | A | 5/1963 | Lindman |
| 3,097,448 | A | 7/1963 | Prunkard |
| 3,126,670 | A | 3/1964 | Smith |
| 3,389,913 | A | 6/1968 | Tunstall |
| 3,532,341 | A | 10/1970 | Shaw |
| 3,626,635 | A | 12/1971 | Birdsall |
| 3,704,777 | A | 12/1972 | Linnebuhr |
| 3,734,502 | A | 5/1973 | Bolton |
| 3,927,620 | A | 12/1975 | Clapham |
| 3,940,135 | A | 2/1976 | Cohen |
| 3,964,746 | A | 6/1976 | MacMurdo |
| 3,965,613 | A | 6/1976 | Saunders |
| RE29,552 | E | 2/1978 | Bolton |
| 4,233,777 | A | 11/1980 | Inoue |
| 4,312,151 | A | 1/1982 | Orenstein |
| 4,448,413 | A | 5/1984 | Weindel et al. |
| 4,527,688 | A | 7/1985 | Jones et al. |
| 4,595,097 | A | 6/1986 | Herstein |
| 4,726,588 | A | 2/1988 | Caprio |

(Continued)

FOREIGN PATENT DOCUMENTS

| | | | |
|---|---|---|---|
| GB | 2041766 | A | 2/1979 |

(Continued)

*Primary Examiner*—Gene Kim
*Assistant Examiner*—Matthew B Stanczak
(74) *Attorney, Agent, or Firm*—Edell, Shapiro & Finnan LLC

(57) ABSTRACT

A toy vehicle package includes a planar backing board upon which an elongated hollow closed-end tube is supported in a spaced arrangement on the board. A slider extends beneath the center tube and supports capsules on either side of the center tube. Magnetic toy vehicles are captivated in both capsules while a third magnetic toy vehicle is movable within the center tube between the closed ends.

19 Claims, 4 Drawing Sheets

U.S. PATENT DOCUMENTS

| | | | | |
|---|---|---|---|---|
| 4,905,828 | A | 3/1990 | Dods | |
| 4,938,728 | A * | 7/1990 | Callari | 446/133 |
| 5,000,318 | A | 3/1991 | Kupersmit | |
| 5,188,555 | A | 2/1993 | Zbegner | |
| 5,377,820 | A | 1/1995 | Christman | |
| 5,411,138 | A | 5/1995 | Klawiter | |
| D371,959 | S | 7/1996 | Hupp | |
| 5,611,432 | A | 3/1997 | Dods | |
| 5,896,991 | A | 4/1999 | Hippely et al. | |
| 6,152,298 | A | 11/2000 | Dods | |
| 6,383,051 | B1 * | 5/2002 | Crossman et al. | 446/83 |
| 6,428,382 | B1 | 8/2002 | Randolph | |
| 2002/0177384 | A1 * | 11/2002 | Mankowski | 446/465 |
| 2004/0056422 | A1 | 3/2004 | Clague | |

FOREIGN PATENT DOCUMENTS

| | | | |
|---|---|---|---|
| GB | 2196320 | A | 4/1988 |

* cited by examiner

PACKAGE FOR MAGNETIC TOY VEHICLES

CROSS-REFERENCE TO RELATED APPLICATION

This application claims the benefit of and priority under 35 U.S.C. 119(e) of U.S. Provisional Patent Application Ser. No. 60/734,434 entitled PACKAGE FOR MAGNETIC TOY VEHICLES filed Nov. 7, 2005 in the name of William O'Keefe, the disclosure of which is incorporated herein by reference.

FIELD OF THE INVENTION

This invention relates generally to toy vehicles having magnetic elements supported therein and particularly to product packaging used therewith.

BACKGROUND OF THE INVENTION

Toy vehicles are well known in the art and have proven to be extremely popular with consumers and have for many years provided high volume sales for toy manufacturers. Because of the popularity of toy vehicles and the intense competition between practitioners in the art, a virtually endless variety of toy vehicles have been provided by manufacturers. As a result, toy vehicles have been provided which are free-wheeling and able to be used in playsets or in manual handling upon a play surface. Further improvements have provided various types of propulsion systems such as wind-up motors and battery-powered drive mechanisms. Additional varieties have included toy vehicles which are featured or articulated to embody some type of mechanism which allows further interaction with the toy vehicles.

Perhaps one of the most competitive areas of toy vehicle manufacture is found in the simple free-rolling toy vehicles. Such toy vehicles are relatively fundamental in their fabrication and generally comprise a body and chassis typically formed of metal or plastic material together with a plurality of freely rotating supporting wheels. In attempting to enhance the competitive advantage and play value of their toy vehicle playsets, practitioners in the art have developed a myriad of accessories and feature apparatus for use with such otherwise simple toy vehicles. One of the more interesting developments as practitioners attempt to enhance the play value of free-wheeling unpowered toy vehicles has arisen in the utilization of magnets within the toy vehicles. The interactive capability of magnets in toy vehicles allows them to interact with metal surfaces or other toy vehicles to produce interesting play patterns.

Another aspect of toy vehicle manufacture and sale which has of late become particularly important in the competitive efforts of toy manufacturers is found in the packaging of the toy vehicles themselves. For many years, packages have been creatively fabricated by practitioners in the art in attempting to attract potential purchasers to particular toy vehicles. Thus, various colorful packaging and images upon that packaging have been utilized. Another recent development in toy vehicle packaging which has proven to be extremely effective is found in the so-called "try-me" packaging. This type of packaging generically referred to as "try-me" packaging has proven to be popular and effective throughout a wide range of toy products and is not limited to toy vehicles but is often well-suited to toy vehicle products.

U.S. Pat. No. 5,896,991 issued to Hippely, et al. sets forth a BLISTER CARD PACKAGE FOR HOLDING AND DISPLAYING SMALL ITEMS having a generally planar rigid backboard upon which a forwardly extending shelf is formed. The shelf defines a plurality of apertures therein. A generally planar support sheet is received upon the shelf and defines a further plurality of apertures. A toy vehicle and toy figure are received upon the sheet and are secured thereto. A transparent blister encloses the toy figure and toy vehicle and is joined to the backing to complete the package.

U.S. Pat. No. 5,611,432 issued to Dods sets forth a MODEL VEHICLE AND TRADING CARD PACKAGING SYSTEM having a generally planar backing upon which a trading card is supported. The backing further supports a shelf extension upon which a toy vehicle is received. The toy vehicle and shelf are enclosed by a transparent plastic blister which is secured to the backing.

U.S. Pat. No. 5,411,138 issued to Klawiter sets forth a PACKAGING FOR A TOY having bottom, top, front, back and side walls defining a box sized to receive a toy and a key. The bottom surface of the box defines an opening aligned with the toy vehicle's slot such that a key may be passed through the bottom box opening into the toy body slot. The key includes a shaft, a head at one end of the shaft and a base at the remaining end. The head is sized to fit through the box opening and body slot and shaped to engage the toy body.

U.S. Pat. No. 5,000,318 issued to Kupersmit sets forth a CONTAINER CONSTRUCTION FOR AUTOMOBILE BODIES having an arrangement suitable for anchoring automobile bodies within a shipping container. The arrangement includes a plurality of inflatable elements which are adapted to project into corresponding openings in a horizontally positioned member in the automobile body. The elements are inflated to engage the edges of the opening and lock the body in place.

U.S. Pat. No. 4,905,828 issued to Dods sets forth a PACKAGE FOR TRADING CARD AND MODEL VEHICLE having a generally planar backing upon which a trading card is supported. The backing further supports a forwardly extending shelf which receives and supports a toy vehicle. A transparent blister encloses the toy vehicle and the shelf and is joined to the backing by adhesive attachment.

U.S. Pat. No. 4,595,097 issued to Herstein sets forth TOY PACKAGING constructed of sheet material having top, bottom and side walls together with a rear wall defining a toy vehicle receiving enclosure. The enclosure defines an open front through which the toy vehicle is inserted and displayed. The bottom wall is provided with a bottom flap configured to be folded inwardly and define an enclosure floor. The flap includes vehicle engaging apparatus for securing the vehicle within the enclosure.

U.S. Pat. No. 4,527,688 issued to Jones, et al. sets forth a TOY STORAGE CASE having an appearance generally resembling a vehicle steering wheel. The center portion of the steering wheel shaped package defines a transparent enclosure within which a toy vehicle is received and enclosed.

U.S. Pat. No. 6,428,382 issued to Randolph sets forth an APPARATUS FOR DISPLAYING A REPRESENTATION OF A WHEELED VEHICLE IN VARIOUS POSES WITH RESPECT TO A PICTORIAL SCENE. A simulated toy vehicle is movable with respect to the background scene to provide variation of display.

U.S. Pat. No. 6,152,298 issued to Dods sets forth a MODEL AND SHAPED CARD PACKAGING SYSTEM AND METHOD FOR SAME utilized in packaging trading cards alone or in combination with toy vehicle models. The package relates to the packaging of trading cards in the shape of entertainment figures and the combination of such cards with model vehicles and display stands.

U.S. Pat. No. Des. 371,959 issued to Hupp sets forth a TRUCK BOX having a generally rectangular shape bearing indicia resembling a truck vehicle. A corner portion of the package defines a corner aperture upon which a transparent viewing window is supported. The window facilitates viewing the toy vehicle within the package.

British Patent 2,196,320 issued to McCarthy sets forth BLISTER PACKS having a generally planar rigid substrate defining an aperture therein. One side of the rigid substrate supports a transparent blister window while the remaining side is open. A foldable flap is formed on the opposite side of the substrate and is movable between an open position and a closing position with respect to the aperture.

Additional prior art devices have been provided which utilize magnets in combination with toy vehicles. For example, U.S. Pat. No. 3,965,613 issued to Sauders sets forth a MAGNETIC TOY having a toy vehicle supporting a magnet at the rear portion thereof. A second magnet is supported at one end of an elongated wand. The user manipulates the toy vehicle by bringing the second magnet which is oriented to repel the first magnet within the vehicle into proximity with the vehicle thereby pushing the vehicle along.

U.S. Pat. No. 3,045,393 issued to Knott; U.S. Pat. No. 3,532,341 issued to Shaw and U.S. Pat. No. 3,626,635 issued to Birdsall set forth examples of early toy vehicle apparatus utilizing magnets.

In addition to use with toy vehicles, magnets have found substantial areas of use in the toy art generally in manners which are generally related to the present invention. U.S. Pat. No. 4,312,151 issued to Orenstein; U.S. Pat. No. 4,233,777 issued to Inoue; U.S. Pat. No. 4,726,588 issued to Caprio; U.S. Pat. No. 3,964,746 issued to MacMurdo; U.S. Pat. No. 577,730 issued to Eberhardt; U.S. Pat. No. 1,533,540 issued to Craigen; U.S. Pat. No. 3,097,448 issued to Prunkard; U.S. Pat. No. 3,091,459 issued to Lindman; U.S. Pat. No. 2,975,551 issued to Oberinger; U.S. Pat. No. 2,904,336 issued to Washburn; U.S. Pat. No. 2,590,002 issued to Frazier; U.S. Pat. No. 2,528,938 issued to Wolf; U.S. Pat. No. 3,704,777 issued to Linnebuhr; U.S. Pat. No. 3,734,502 issued to Bolten; U.S. Pat. No. 3,940,135 issued to Cohen; U.S. Pat. No. 3,927,620 issued to Clapham; U.S. Pat. No. 5,188,555 issued to Zbegner; U.S. Pat. No. 5,377,820 issued to Christman; Re. U.S. Pat. No. 29,552 and British Patent 2,041,766 all shown apparatus generally related to the present invention in that they utilize magnets in one fashion or another.

Additional prior art generally related to the present invention is found in U.S. Pat. No. 3,126,670 issued to Smith; U.S. Pat. No. 3,389,913 issued to Tunstall; U.S. Pat. No. 4,448,413 issued to Weindel, et al. and Published U.S. Patent Application 2004/0056422.

While the foregoing described prior art devices have to some extent improved the art and have in some instances enjoyed commercial success, there remains nonetheless a continuing need in the art for evermore improved, amusing and interesting toy vehicle packages.

SUMMARY OF THE INVENTION

Accordingly, it is a general object of the present invention to provide an improved package for toy vehicles. It is more particular object of the present invention to provide an improved package for toy vehicles for use in combination with toy vehicles having magnetic features supported thereon.

In accordance with the present invention, there is provided a package for magnetic toy vehicles providing a generally planar board upon which an elongated hollow center tube, preferably formed of a transparent plastic material or the like, is secured. A pair of end spacers support the center tube above the supporting board to form a gap therebetween. Each opposed end of the center tube is closed with a plug to provide a closed end passage within the center tube. A toy vehicle is captivated within the closed passage of the center tube and is freely movable between the plug ends. The package further includes a slider having a slide plate which extends transversely beneath the center tube within the gap formed between the center tube and the board. The opposed ends of the slide plate support a pair of closed slide tubes each of which further supports a toy vehicle captive therein. Each of the toy vehicles supports one or more magnets which are oriented to provide repelling force between each of the vehicles within the side tubes against the vehicle captive within the center tube.

In operation, as the slide having the pair of magnetic cars supported on either side of the center tube is moved toward the toy vehicle within the center tube, the repelling force of the car magnets causes the toy vehicle within the center tube to be driven away from the slide. This continues as the user moves the slide toward the center tube car until the center tube car impacts an end plug of the center tube. Thereafter, continued movement of the slide causes the repelling force between the car magnets to abruptly drive the center tube toy vehicle away from the end plug in a rapid movement toward the opposite end of the center tube. In the anticipated play pattern, each time the user moves the slide toward the center tube car this cycle repeats and the center tube car is moved, then is driven against the end plug, and thereafter is rapidly accelerated away from the plug in response to magnetic force. Since there are plugs at both ends of the center tube, the action is repeated at either end of the center tube.

From another perspective, the present invention provides a toy vehicle package for magnetic toy vehicles, the package comprising: a package support; a hollow closed-end center tube having a first magnetic toy vehicle movable therein between the closed ends; means supporting the center tube upon the support defining a space therebetween; a slider extending beneath the center tube through the space; and a pair of side tubes, having second and third magnetic toy vehicle therein, supported on the slider on opposite sides of the center tube, the first magnetic toy vehicle being moved within the center tube under the influence of the second and third magnets as the slider is moved.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

By way of overview, the present invention package for magnetic toy vehicles provides a "try-me" feature which dramatically demonstrates the magnetic interactive actions of toy vehicles. In its anticipated use, the present invention package contemplates the packaging of toy vehicles which are freely rolling and which are provided with magnetic properties. The magnetic properties typically are provided by embedded permanent magnets supported upon or within the toy vehicles. Of particular importance in contemplating the effective use of the present invention package is the orientation of the magnets within the toy vehicles therein. In the preferred embodiment, a repelling force between the magnets in each toy vehicle causes the outer toy vehicles to exert repelling forces against the freely movable center tube vehicle. This action of repelling force allows the user to "magically" move the center tube toy vehicle by manipulating the slide in the manner referred to above and described below in greater detail.

Thus, the present invention package utilizes a planar base supporting a hollow center tube having closed ends which is preferably formed of a transparent or clear plastic material. A magnetic toy vehicle is freely movable between the end closures of the center tube. The package also includes a slider movable between the end supports of the center tube which in turn supports a pair of captive toy vehicles on opposite sides of the center tube. The magnetic orientation of magnetic elements within the side tube toy vehicles and the center tube toy vehicle provide repulsive forces between the center tube toy vehicle and the side tube vehicles. As a result, each time the slide is moved to bring the side tube toy vehicles into proximity with the center tube toy vehicle, the resulting magnetic repelling force therebetween drives the center tube toy vehicle. The effect is particularly dramatic once the center tube toy vehicle has reached an end plug within the center tube. Thereafter, as the slide continues to move bringing the side toy vehicles into alignment with the center tube toy vehicle, the center toy vehicle is suddenly and dramatically accelerated away from the tube end toward the opposite end in a snap-action type movement.

Figure 1:
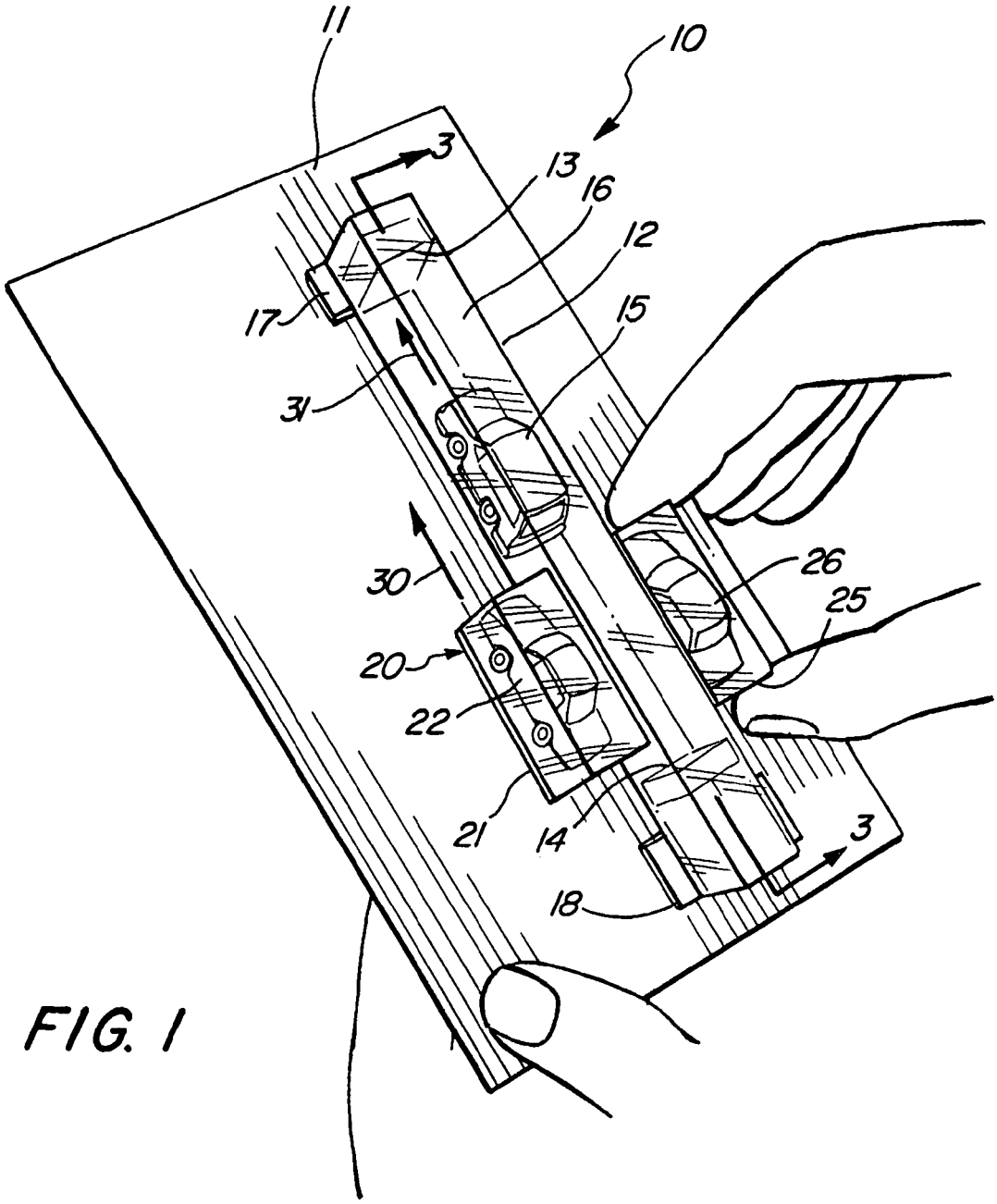
FIG. 1 sets forth a perspective view of a toy vehicle package constructed in accordance with the present invention.

More specifically, FIG. 1 sets forth a toy vehicle package constructed in accordance with the present invention and generally referenced by numeral 10. Package 10 includes a planar supporting board 11 preferably made of a cardboard or flakeboard material upon which a center tube 12 is supported by a pair of end spacer supports 17 and 18. Center tube 12 defines an interior passage 16 within which a pair of end plugs 13 and 14 are secured to provide closure of interior passage 16. A magnetic toy vehicle 15 is freely movable between end plugs 13 and 14 within passage 16. Package 10 further includes a slide 20 having a slide plate 29 (seen in FIG. 3) which extends beneath center tube 12 and supports a pair of side tubes 21 and 25. Tubes 21 and 25 support respective magnetic toy vehicles 22 and 26 in a captive support.

In operation with toy vehicle 15 positioned as shown, the user moves slide 20 in the direction indicated by arrow 30. The repulsive magnetic force exerted by toy vehicles 22 and 26 upon toy vehicle 15 accelerates toy vehicle 15 in the direction indicated by arrow 31. This movement of toy vehicle 15 continues so long as slide 20 is moved in the direction of arrow 30. Once toy vehicle 15 reaches end plug 13, further movement in the direction of arrow 31 is no longer possible. Thereafter, as slide 30 is moved upwardly in the direction of arrow 30 bringing toy vehicles 22 and 26 to the position shown in FIG. 2, the repulsive forces between the toy vehicles causes toy vehicle 15 to suddenly accelerate downwardly away from plug 13.

It will be apparent to those skilled in the art that an opposite direction play pattern is also provided once toy vehicle 15 is moved to a position beneath slide 20. In this reversed operation, the magnetic repulsive forces drive toy vehicle 15 downwardly until it reaches plug 14. Thereafter as slide 20 is once again moved downwardly bringing toy vehicles 22 and 26 alongside toy vehicle 15, the magnetic repulsive forces causes a second opposite direction dramatic movement of toy vehicle 15 sending it upwardly through center tube 12.

Thus as the user moves slide 20 back and forth between its end positions, the rapid movement of toy vehicle 15 provides a dramatic "try-me" play pattern.

Figure 2:
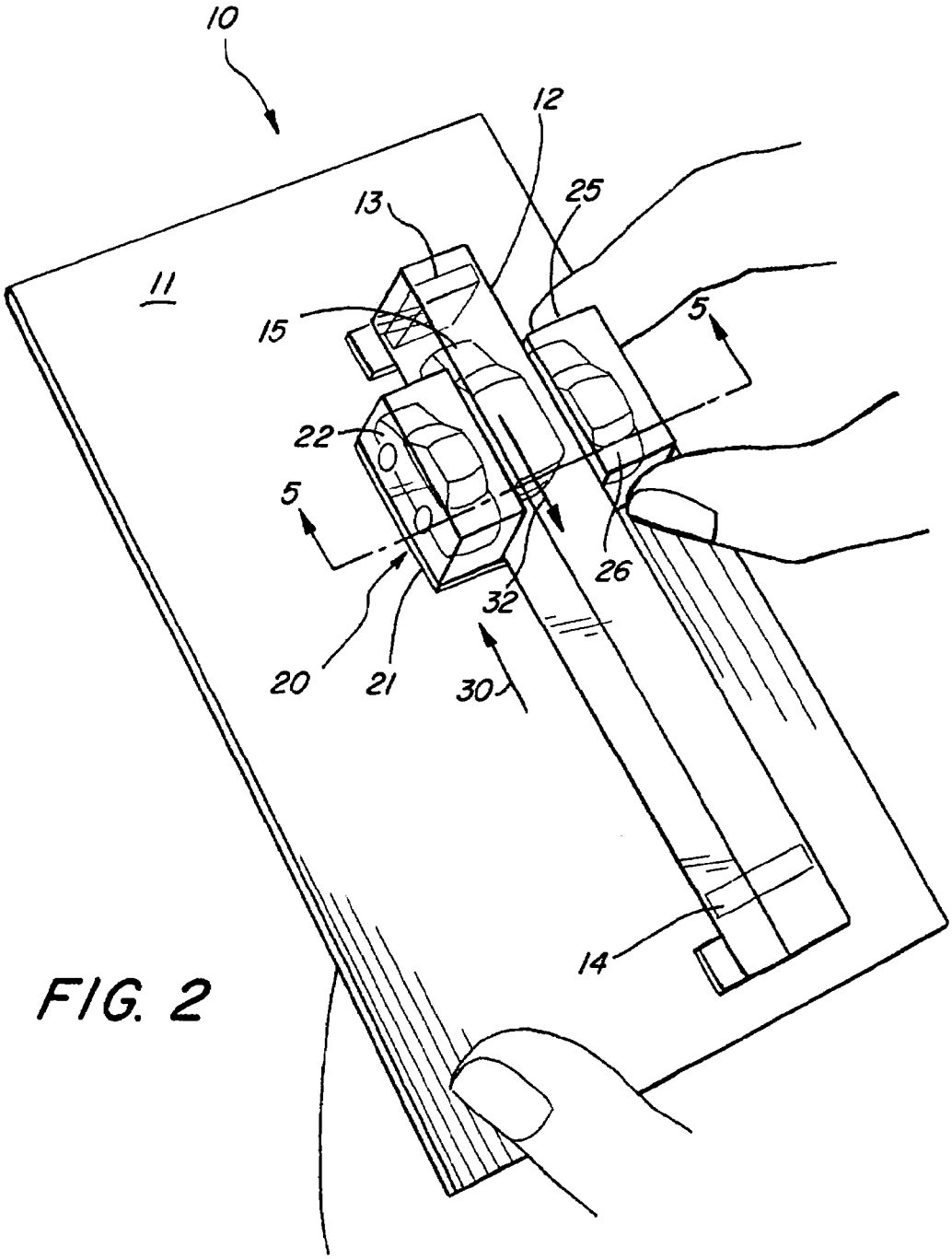
FIG. 2 sets forth a further perspective view of the present invention toy vehicle package.

FIG. 2 sets forth the present invention toy vehicle package showing the approach of the upper end of travel of slide 20. This upper end is referred to above in connection with FIG. 1 and results in bringing toy vehicles 22 and 25 alongside toy vehicle 15 causing it to be rapidly accelerated downwardly in the direction indicated by arrow 32.

More specifically, FIG. 1 sets forth a toy vehicle package constructed in accordance with the present invention and generally referenced by numeral 10. Package 10 includes a planar supporting board 11 preferably made of a cardboard or flakeboard material upon which a center tube 12 is supported by a pair of end spacer supports 17 and 18. Center tube 12 defines an interior passage 16 within which a pair of end plugs 13 and 14 are secured to provide closure of interior passage 16. A magnetic toy vehicle 15 is freely movable between end plugs 13 and 14 within passage 16. Package 10 further includes a slide 20 having a slide plate 29 (seen in FIG. 3) which extends beneath center tube 12 and supports a pair of side tubes 21 and 25. Tubes 21 and 25 support respective magnetic toy vehicles 22 and 26 in a captive support.

Figure 3:
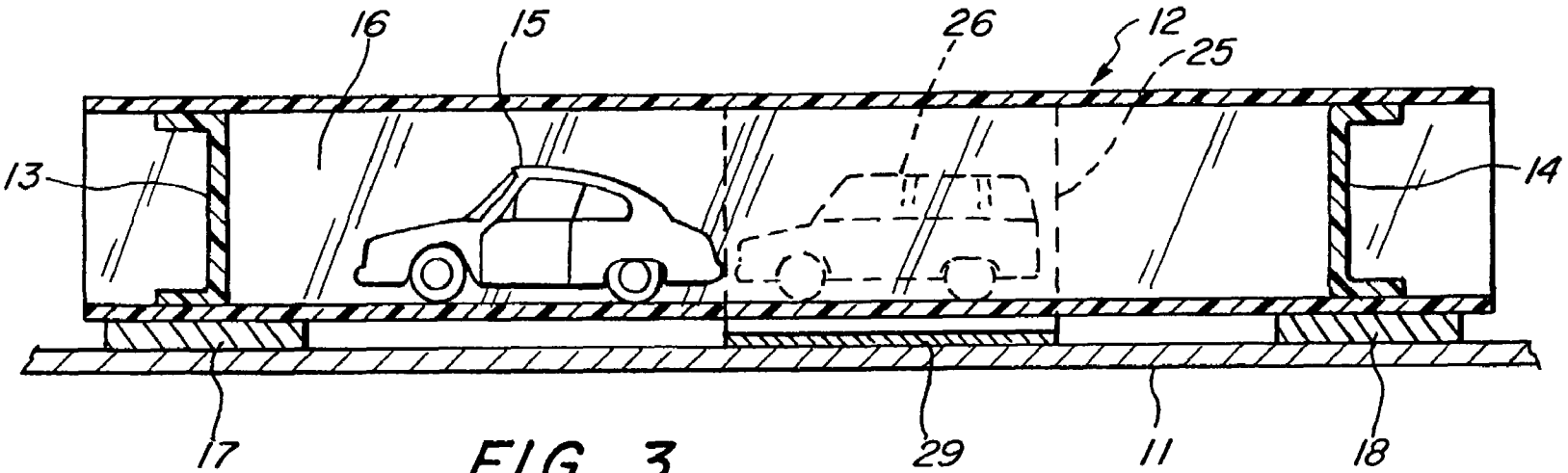
FIG. 3 sets forth a section view of the center tube portion of the present invention toy vehicle package taken along section lines 3-3 in FIG. 1.

FIG. 3 sets forth a section view of center tube 12 taken along section lines 3-3 in FIG. 1. As described above, center tube 12 comprises a hollow transparent preferably clear plastic tube defining an interior passage 16. A pair of end plugs 13 and 14 provide closed ends for interior passage 16. As is also described above, center tube 12 is supported above a rigid planar board 11 to provide a space between the underside of center tube 12 and the upper surface of board 11. End spacer supports 17 and 18 secure the end portions of center tube 12 to board 11 and provide this space. A slide plate 29 extends transversely beneath center tube 12 traversing within the space formed between board 11 and the underside of center tube 12. As is better seen in FIG. 1, slide plate 29 supports a pair of side tubes 21 and 25 within which a pair of toy vehicles 22 and 26 are supported. Returning to FIG. 3, slide plate 29 is shown supporting side tube 25 and toy vehicle 26. FIG. 3 also shows toy vehicle 15 captive within interior passage 16.

Figure 4:
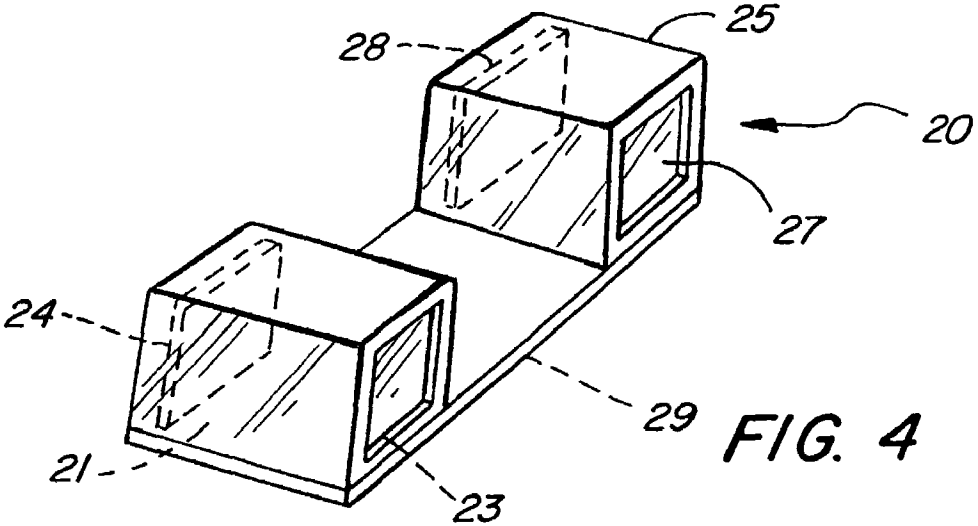
FIG. 4 sets forth a perspective view of the slide portion of the present invention toy vehicle package.

FIG. 4 sets forth a perspective view of slide 20 removed from the remainder of the present invention package. Slide 20 includes a generally planar slide plate 29 upon which a pair of side tubes 21 and 25 are secured. Side tubes 21 and 25 are spaced apart a sufficient distance to permit center tube 12 (seen in FIG. 1) to pass therebetween. Side tube 21 is closed at opposite ends by plugs 23 and 24 while side tube 25 is closed at respective ends 27 and 28.

Figure 5:
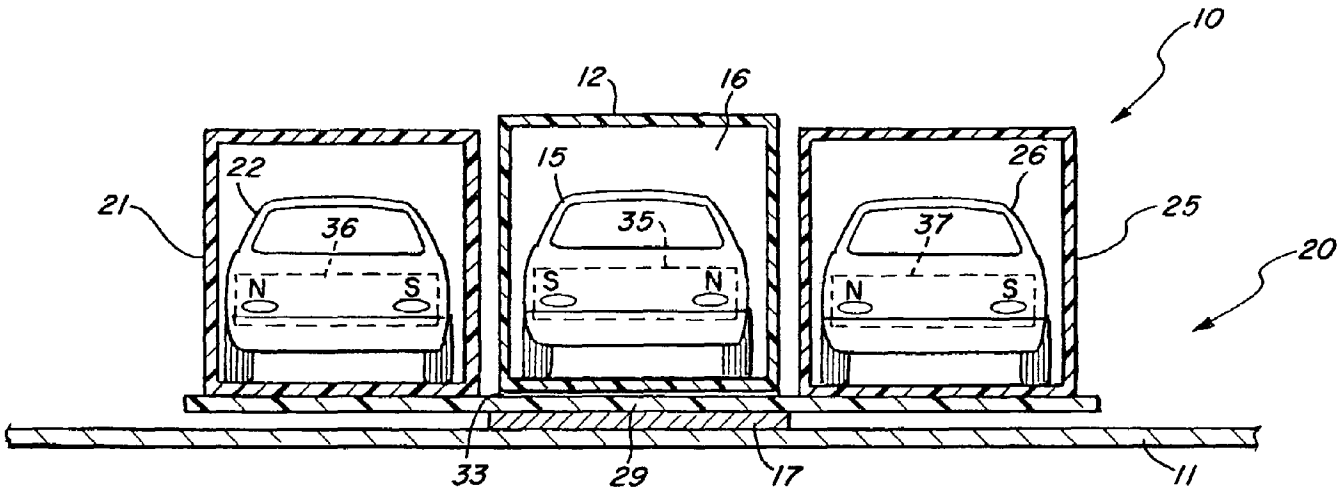
FIG. 5 sets forth a section view of the present invention toy vehicle package taken along section lines 5-5 in FIG. 2.

FIG. 5 sets forth a section view of package 10 taken along section lines 5-5 in FIG. 2. Package 10 includes a planar board 11 upon which a center tube 12 is supported by a pair of end spacer supports 17 and 18 (support 18 seen in FIG. 3). Center tube 12 defines a closed interior passage 16 within which a magnetic toy vehicle 15 is freely rollable.

A slide 20 includes a slide plate 29 passing beneath the bottom surface of center tube 12 such that a gap 33 is formed therebetween. Slide 20 includes a pair of side tubes 21 and 25 within which respective magnetic toy vehicles 22 and 26 are captive.

As described above, toy vehicles 15, 22 and 26 possess "magnetic characteristics". As is also expressed above, these magnetic characteristics are most likely obtained by embedding one or more permanent magnets within the toy vehicles. Thus for purposes of illustration, toy vehicle 15 is shown having a magnet 35 embedded therein while toy vehicles 22 and 26 support embedded permanent magnets 36 and 37.

In obtaining the repulsive forces between toy vehicles 22 and 26 against toy vehicle 15, the magnetic poles or polarities of the embedded magnets within each of the toy vehicles must be of like polarity. Thus, FIG. 5 shows one possible scheme in which the orientation of magnetic poles is provided such that a north pole to north pole repulsion is exerted between toy vehicles 15 and 26 while a south pole to south pole repulsive force is exerted between toy vehicles 15 and 22. It will be apparent to those skilled in the art, however, that the positioning of magnets within the toy vehicles of FIG. 5 is merely illustrative of a variety of different magnetic combinations with the essential provision being repulsive force between the side tube toy vehicles against the center tube toy vehicle. Accordingly, a plurality of magnets within the toy vehicles may be used in different configurations without departing from the spirit and scope of the present invention.

Figure 6:
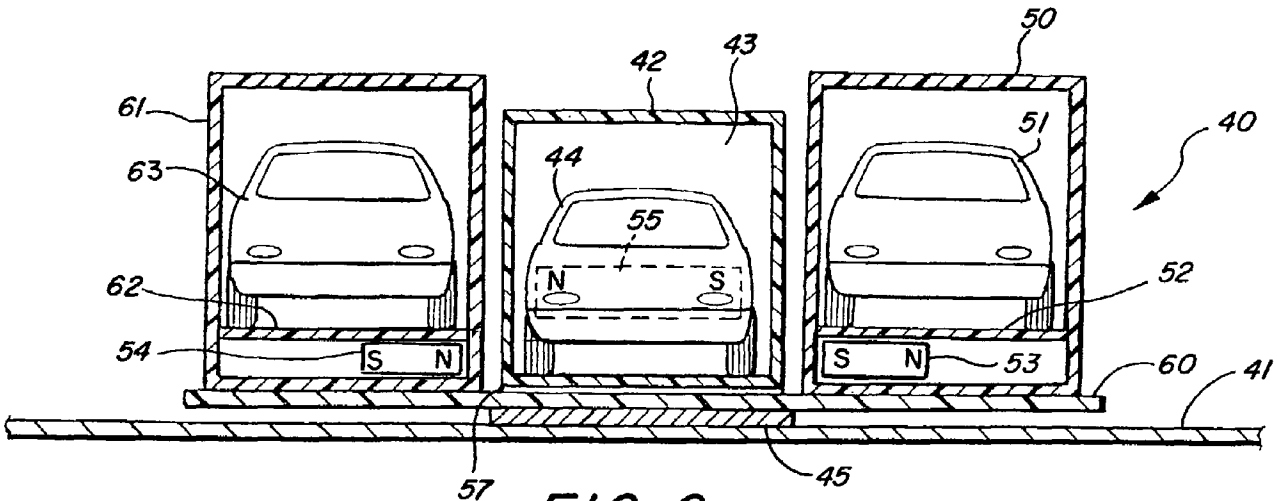
FIG. 6 sets forth a section view of an alternate embodiment of the present invention toy vehicle package.

FIG. 6 sets forth a section view of an alternate embodiment of the present invention package for magnetic toy vehicles generally referenced by numeral 40. By way of overview, FIG. 6 illustrates an alternative configuration in which a magnetic toy vehicle is utilized within the center tube of the package while nonmagnetic toy vehicles may be utilized in the side tubes. Alternatively, the toy vehicles within the side tubes may be eliminated. The ability to use nonmagnetic side tube toy vehicles or eliminate the side tube toy vehicles entirely is provided by the use of permanent magnets within the side tubes themselves which are not embedded within the toy vehicles. It will be apparent that the movement of the slide in the embodiment shown in FIG. 6 provides the same magnetic repulsive forces against the toy vehicle within the center tube and thus provides the same operation.

More specifically, toy vehicle package 40 is fabricated in general accordance with toy vehicle package described above with the changes being found in the use of magnets within the side tubes rather than magnets embedded within the toy vehicles. Thus, package 40 includes a center tube 42 defining a closed end interior passage 43 within which a magnetic toy vehicle 44 is freely movable. Toy vehicle 44 supports an embedded permanent magnet 55. A pair of end spacers such as spacer 45 support center tube 42 upon a planar board 41.

A slide plate 60 extends beneath center tube 42 and supports a pair of side tubes 50 and 61. Side tube 50 supports a platform 52 upon which a toy vehicle 51 is captive together with a magnet 53 beneath platform 52. Similarly, side tube 61 supports a platform 62 beneath which a magnet 54 is supported and above which a toy vehicle 63 is captive. The orientations between magnets 55, 53 and 54 is provided to cause magnets 53 and 54 to exert a repulsive force against magnet 55. The result is that the operation of package 40 is identical to the above-described operation of package 10. The only difference found in package 40 with respect to package 10 is the use of magnets 53 and 54 which are embedded within side tubes 50 and 61 respectively. These embedded magnets remove the need for magnetic characteristics of cars 51 and 63 and in fact provide that cars 51 and 63 need not be positioned within tubes 50 and 61 to ensure operation of the "try-me" package.

What has been shown is a novel toy vehicle package which provides a dramatic "try-me" feature to demonstrate the operation of magnetically active toy vehicles. The feature provided does not require any battery cooperation or use of any power other than the manual effort required to move the slider. The effect is dramatic particularly as the center tube vehicle reaches its end travel and is rapidly shot from the captive end to the opposite end of the center tube due to magnetic repulsive forces.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A toy vehicle package for magnetic toy vehicles, said package comprising:

a package support;

a hollow center tube having closed-ends, and a first magnetic toy vehicle movable within said center tube between said closed ends;

means supporting said center tube upon said support defining a space therebetween;

a slider extending beneath said center tube through said space; and a pair of side tubes, having second and third magnetic toy vehicles therein, supported on said slider on opposite sides of said center tube, said first magnetic toy vehicle being moved within said center tube under the influence of said second and third magnetic toy vehicles as said slider is moved.

2. The toy vehicle package set forth in claim 1 wherein said center tube is formed of a transparent material.

3. The toy vehicle package set forth in claim 2 wherein said side tubes are formed of a transparent material.

4. The toy vehicle package set forth in claim 3 wherein said package support includes a generally planar board.

5. The toy vehicle package set forth in claim 4 wherein said center tube is generally straight-line in its shape.

6. A toy vehicle package for magnetic toy vehicles, said package comprising:

a package support;

an elongated closed-end center tube having closed ends and supported upon said package support;

a first magnetic toy vehicle movable within said center tube between said closed ends; and a movable magnetic element movably supported upon said package support movable along said center tube to cause said toy vehicle to move within said center tube.

7. The toy vehicle package set forth in claim 6 wherein said magnetic element is a second magnetic toy vehicle.

8. The toy vehicle package set forth in claim 7 wherein said movable magnetic element includes a slider movable along a portion of said center tubes.

9. The toy vehicle package set forth in claim 8 wherein said movable magnetic element includes a third magnetic toy vehicle.

10. The toy vehicle package set forth in claim 9 wherein said second and third magnetic toy vehicles are supported on opposite sides of said center tube.

11. The toy vehicle package set forth in claim 10 wherein said center tube is formed of a transparent material.

12. The toy vehicle package set forth in claim 11 wherein said side tubes are formed of a transparent material.

13. The toy vehicle package set forth in claim 6 wherein said package support includes a generally planar board.

14. The toy vehicle package set forth in claim 13 wherein said center tube is generally straight-line in its shape.

15. A toy vehicle package for magnetic toy vehicles, said package comprising:

a hollow center tube having closed ends;

a slider movable in proximity to and along said center tube between said closed ends;

a first magnetic toy vehicle freely movable within said center tube between said closed ends; and a second magnetic toy vehicle supported upon said slider, said first magnetic toy vehicle being moved within said center tube as said slider and said second magnetic toy vehicle is moved.

16. The toy vehicle package set forth in claim 15 further including a third magnetic toy vehicle supported on said slider.

17. The toy vehicle package set forth in claim 16 wherein said second and third magnetic toy vehicles are supported on opposite sides of said center tube.

18. The toy vehicle package set forth in claim 17 wherein said center tube is formed of a transparent material.

19. The toy vehicle package set forth in claim 18 wherein said center tube is generally straight-line in its shape.

* * * * *